US005424179A

United States Patent [19]

Tang et al.

[11] Patent Number: 5,424,179

[45] Date of Patent: Jun. 13, 1995

[54] PHOTOGRAPHIC ELEMENT WITH A CYCLIC AZOLE COUPLER HAVING A SACCHARIN SUBSTITUENT

[75] Inventors: Ping W. Tang; Terrence C. Mungal, both of Rochester, N.Y.

[73] Assignee: Eastman Kodak Company, Rochester, N.Y.

[21] Appl. No.: 289,074

[22] Filed: Aug. 11, 1994

[51] Int. Cl.[6] ..... G03C 7/38

[52] U.S. Cl. ..... 430/558; 430/567

[58] Field of Search ..... 430/558, 567

[56] References Cited

U.S. PATENT DOCUMENTS

| | | | |
|---|---|---|---|
| 3,725,067 | 4/1973 | Bailey et al. | 96/56.5 |
| 4,540,654 | 9/1985 | Sato et al. | 430/381 |
| 4,585,732 | 4/1986 | Kawagishi et al. | 430/558 |
| 4,728,598 | 3/1988 | Bailey et al. | 430/387 |
| 4,873,183 | 10/1989 | Tachibana et al. | 430/550 |
| 4,882,266 | 11/1989 | Kawagishi et al. | 430/546 |
| 4,916,051 | 4/1990 | Tachibana et al. | 430/558 |
| 5,051,343 | 9/1991 | Lestina et al. | 430/393 |
| 5,206,130 | 4/1993 | Shimada et al. | 430/558 |

FOREIGN PATENT DOCUMENTS

| | | | |
|---|---|---|---|
| 0119741 | 5/1988 | European Pat. Off. | G03C 7/38 |
| 4260036 | 9/1992 | Japan | 430/558 |
| 1252418 | 11/1971 | United Kingdom | C07D 57/24 |
| 1334515 | 11/1983 | United Kingdom | C07D 55/06 |

OTHER PUBLICATIONS

Research Disclosure, Dec. 1989, Item 308119, published by KennethMason Publications, Ltd., Dudley Annex, 12a North Street, Emsworth, Hampshire P010 7DQ, England.

*Primary Examiner*—Lee C. Wright
*Attorney, Agent, or Firm*—Joshua G. Levitt

[57] ABSTRACT

Novel cyclic azole couplers and photographic elements containing them are described. The couplers are represented by the following structure:

wherein:

COUP is a cyclic azole coupler moiety;

$R_1$, $R_2$ and $R_3$ independently represent hydrogen or a substituent;

L is a linking group joining the azole ring and the aryleneoxy group;

G is a bi-valent linking group; and m is an integer of 0 to 2.

6 Claims, No Drawings

PHOTOGRAPHIC ELEMENT WITH A CYCLIC AZOLE COUPLER HAVING A SACCHARIN SUBSTITUENT

FIELD OF THE INVENTION

This invention relates to novel cyclic azole dye-forming couplers having a saccharin substituent and to light sensitive silver halide color photographic elements employing them.

BACKGROUND OF THE INVENTION

In the photographic art color images are formed by exposing a light sensitive silver halide photographic element to actinic radiation, followed by processing in which an oxidized aromatic primary amine color developing agent is reacted with a dye-forming coupler to form yellow, magenta and cyan image dyes in the element.

Among the known magenta dye-forming couplers are cyclic azoles such as pyrazolobenzimidazoles, pyrazolotriazoles, and imidazopyrazoles. More recently, some cyclic azoles have been described as cyan dye-forming couplers. Representative patents include U.S. Pat. Nos. 3,725,067, 4,540,654, 4,728,598, 4,873,183, 4,882,266, 4,916,051 and 5,206,130.

Dye-forming couplers in photographic elements should have good coupling efficiency and lead to dyes having desired hues. Coupling efficiency refers to how well the coupler reacts with oxidized silver halide developing agent to form dye under actual processing conditions. The larger the amount of dye produced per unit developed silver during the common processing time, other things being equal, the more efficient the coupler.

While many known cyclic azole couplers have desired hues, many do not have as good coupling efficiency as would be desirable. Thus, it would be desirable to have azole couplers with improved coupling efficiency.

Couplers which contain saccharin groups are known from U.S. Pat. Nos. 4,540,654, 4,585,732 and 5,051,343. However, in the couplers shown in these patents the saccharin group is in the coupling position, from which position it would be cleaved on coupling. In couplers of the present invention, the saccharin group is attached to a position from which it will not cleave as a result of coupling. Typically it forms part of the ballast group which renders the coupler and the dye formed from it nondiffusible in the layer in which it is coated.

SUMMARY OF THE INVENTION

In accordance with the present invention there is provided a light-sensitive photographic element comprising a support bearing a silver halide emulsion associated with a cyclic azole dye-forming coupler having the structure shown in Formula I, below:

Formula (I)

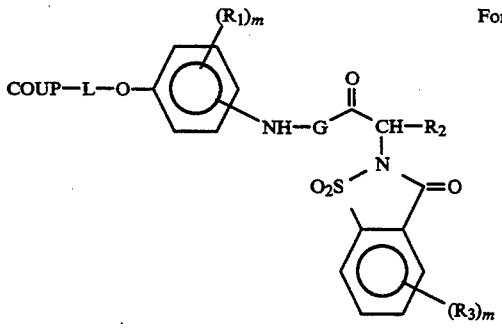

wherein:

COUP is a cyclic azole coupler moiety;

$R_1$, $R_2$ and $R_3$ independently represent hydrogen or a substituent;

L is a linking group joining the aryleneoxy group to a position on the azole ring other than the coupling position;

G is a bi-valent linking group; and m is an integer of 0 to 2.

The novel azole couplers of this invention have good coupling efficiency. This is the result both of the saccharin group and of the aryleneoxy group in the link between the saccharin group and the azole ring system.

DETAILED DESCRIPTION OF THE INVENTION

The azole coupler moiety represented by COUP can be any of the bridgehead nitrogen 5,5 fused ring systems know in the art, these include:

pyrrolo[1,2-b]pyrazoles,
pyrazolo[3,2-c][1,2,4]triazoles,
pyrazolo[2,3-b][1,2,4]triazoles,
imidazo[1,2-b]pyrazoles,
imidazo[1,5-b]pyrazoles,
imidazo[1,2-a]imidazoles,
imidazo[1,2-b][1,2,4]triazoles,
imidazo[2,1-c][1,2,4]triazoles,
imidazo[5,1-c][1,2,4]triazoles and
[1,2,4]triazolo[3,4-c][1,2,4]triazole.

Couplers with ring systems that can be substituted in accordance with this invention are described in the following patents, the disclosures of which are incorporated by reference: U.S. Pat. Nos. 3,725,067, 4,540,654 and 4,882,266, British Patents 1,252,418 and 1,334,515, and European Published Patent Application 119,741. Preferred couplers of this invention contain a pyrazolotriazole ring system.

The saccharin ballast can be joined to any available position of the azole ring, other than the coupling position.

The linking group represented by L can be alkylene, arylene, alkylenesulfonyl or arylenesulfonyl.

Each of the $R_1$ substituents can be alkyl or aryl and can be joined to the aryl ring via a hetero atom, such as oxygen or sulfur.

The linking group represented by G can be a chemical bond, oxyalkylene, oxyarylene, carbonylalkylene or carbonylarylene.

The $R_2$ subsitutent can be hydrogen, halogen, or an aliphatic, aromatic or heterocyclic group.

Each of the $R_3$ substituents can be hydroxy, halo, nitro, cyano, alkyl, alkoxy, aryl, aryloxy, alkylamino, alkylcarbonamido, alkylsulfonamido, heterocyclyl and trialkylsiloxy.

Preferred cyclic azole couplers are pyrazolotriazoles represented by Formula II:

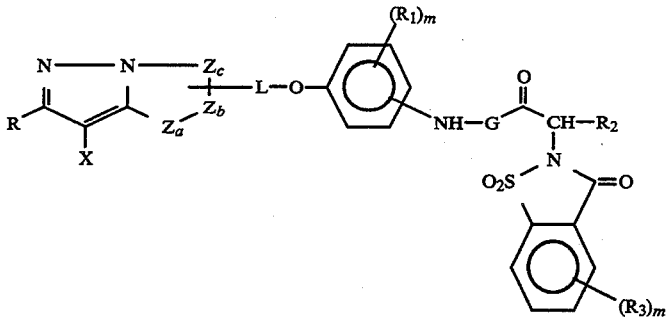

Formula (II)

wherein:

$R_1$, $R_2$, $R_3$, L, G, and m are as previously defined;

R is hydrogen or a substituent;

X is hydrogen or a coupling-off-group; and

Za, Zb, and Zc are independently a substituted or unsubstituted methine group, =N—,

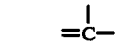

or —NH—, provided that one of either the Za—Zb bond or the Zb—Zc bond is a double bond and the other is a single bond, and when the Zb—Zc bond is a carbon-carbon double bond, it can be part of the aromatic ring and at least one of Za, Zb, and Zc represents a methine group connected to L.

Preferred pyrazolotriazole couplers of this invention are 1H-pyrazolo[2,3-b][1,2,4]triazoles represented by Formula III:

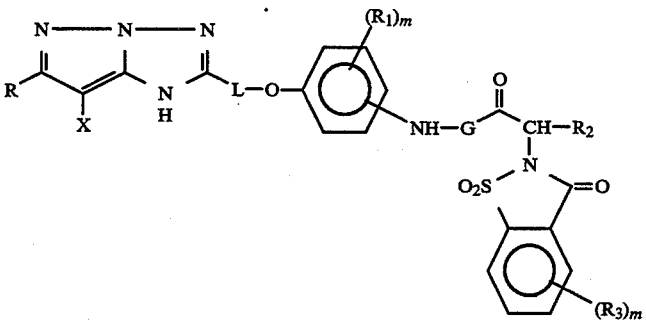

Formula (III)

wherein:

X, R, $R_1$, $R_2$, $R_3$, L, G, and m are as previously defined.

As used herein, unless otherwise indicated the alkyl and aryl groups, and the alkyl and aryl portions of groups can be unsubstituted or substituted with non-interfering substituents. Typical alkyl groups have 1 to 32 carbon atoms and typical aryl groups have 6 to 32 carbon atoms. Depending upon the position of the group, preferred alkyl groups can have 1 to 20 carbon atom, 1 to 12 carbon atoms or 1 to 4 carbon atoms and preferred aryl groups can have 6 to 20 or 6 to 10 carbon atoms. Other groups identified below which contain a replacable hydrogen atom can be substituted or not, depending on the particular structure and properties desired.

Examples of suitable L linking groups are alkylene, arylene, alkylenesulfonyl or arylenesulfonyl, such as methylene, butylene, phenylene, tolylene, phenylenesulfonyl and propylenesulfonyl.

Examples of suitable $R_1$ substituents are alkyl, aryl, alkoxy, aryloxy, arylthio and alkylthio of 1 to 32 carbon atoms such as methyl, ethyl, propyl, isopropyl, t-butyl, t-decyl, 2-methanesulfonylethyl, 3-(3-pentadecylphenoxy) propyl, 3-[4-{2-[4(4-hydroxyphenylsulfonyl) phenoxy] dodecanamide} phenyl) propyl, 2-ethoxytridecyl, trifluoromethyl, cyclopentyl, 3-(2,4-di-t-amylphenoxy)propyl, phenyl, 4-t-butylphenyl, 2,4-di-t-amylphenyl, 4-tetradecanamidephenyl, methoxy, ethoxy, 2-methoxyethoxy, 2-dodecylethoxy, 2-methanesulfonylethoxy, phenoxy, 2-methylphenoxy, 4-t-butylphenoxy, 3-nitrophenoxy, 3-t-butyloxycarbamoylphenoxy, methylthio, octylthio, tetradecylthio, 2-phenoxyethylthio, 3-phenoxypropylthio, 3-(4-t-butylphenoxy)propylthio, phenylthio, 2-butoxy-5-t-octylphenylthio, 3-pentadecylphenylthio, 2-carboxyphenylthio and 4-tetradecanamidephenylthio.

Examples of suitable G linking groups are a covalent bond, oxyalkylene, oxyarylene, carbonylalkylene or carbonylarylene, such as oxymethylene, oxy-t-butylene, oxyphenylene, carbonylphenylene, carbonyltolylene, and carbonylpropyleneoxy.

Examples of suitable $R_2$ substituents include hydrogen, halogen, straight or branched alkyl or alkenyl or alkynyl group having 1 to 32 carbon atoms, a heterocycle, an aralkyl group, a cycloalkyl group or a cycloalkenyl group. The aliphatic residue may be substituted with a substituent bonded through an oxygen atom, a nitrogen atom, a sulfur atom or a carbonyl group, a hydroxy group, an amino group, a nitro group, a carboxy group, an amido group, cyano or halogen.

Preferably $R_2$ is hydrogen or an alkyl group having 1 to 32 carbon atoms.

Examples of suitable $R_3$ substituents are hydroxy, nitro, cyano, halogen for example, chloro and bromo; alkyl, aralkyl, alkenyl, alkynyl, cycloalkyl and cycloalkenyl, such as methyl, ethyl, propyl, isopropyl, t-butyl, tridecyl, 2-methanesulfonylethyl, 3-(3-pentadecylphenoxy) propyl, 2-ethoxytridecyl, trifluoromethyl, cyclopentyl, and 3-(2,4-di-t-amylphenoxy)propyl; aryl, for example, phenyl, 4-t-butylphenyl, 2,4-di-t-amylphenyl, and 4-tetradecanamidephenyl; heterocyclyl, for example, 2-furyl, 2-thienyl, 2-pyrimidinyl, and 2-benzothiazolyl; alkoxy, for example, methoxy, ethoxy, 2-methoxyethoxy, 2-dodecylethoxy, and 2-methanesulfonylethoxy; aryloxy, for example, phenoxy, 2-methylphenoxy, 4-t-butylphenoxy, 3-nitrophenoxy, 3-t-butyloxycarbamoylphenoxy, and 3-methoxycarbamoyl; acylamino, for example, acetamido, benzamido, tetradecanamido, 2-(2,4-di-t-amylphenoxy)-butanamido, 4-(3-t-butyl-4-hydroxyphenoxy)-butanamido, and 2-[4-(4-hydroxyphenylsulfonyl)-phenoxy]decanamido; alkylamino, for example, methylamino, butylamino, dodecylamino, diethylamino, and methylbutylamino; sulfamoylamino, for example, N,N-dipropylsulfamoylamino, and N-methyl-N-decylsulfamoylamino; alkylthio, for example, methylthio, octylthio, tetradecylthio, 2-phenoxyethylthio, 3-phenoxypropyl-thio, and 3-(4-t-butyl-phenoxy)propylthio; arylthio, for example, phenylthio, 2-butoxy-5-t-octylphenylthio, 3-pentadecylphenylthio, 2-carboxyphenylthio and 4-tetradecanamidephenylthio; alkoxycarbonylamino, for example, methoxycarbonylamino and tetradecyloxycarbonylamino; sulfonamido, for example, methanesulfonamido, hexadecanesulfonamido, benzenesulfonamido, p-toluenesulfonamido, octadecanesulfonamido, and 2-methoxy-5-t-butylbenzenesulfonamido; carbamoyl, for example, N-ethylcarbamoyl, N,N-dibutylcarbamoyl, N-(2-dodecyloxyethyl) carbamoyl, N-methyl-N-dodecylcarbamoyl, and N-[3-(2,4-di-t-amylphenoxy) propyl]-carbamoyl; sulfamoyl, for example, N-ethylsulfamoyl, N,N-dipropylsulfamoyl, N-(2-dodecyloxyethyl)-sulfamoyl, N-ethyl-N-dodecylsulfamoyl, and N,N-diethylsulfamoyl; sulfonyl, for example, methanesulfonyl, octanesulfonyl, benzenesulfonyl, and toluenesulfonyl; and silyloxy, for example, trimethysilyloxy and dibutylmethylsilyloxy.

Preferably m is 0 or 1 and, when m is 1, $R_3$ preferably is nitro, cyano, a carbonamide, or a sulfonamide.

Examples of suitable R substituents are alkyl which can be straight or branched, such as methyl, ethyl, n-propyl, n-butyl, t-butyl, trifluoromethyl, tridecyl or 3-(2,4-di-t-amylphenoxy)propyl; alkoxy, such as methoxy or ethoxy; alkylthio, such as methylthio or octylthio; aryl, aryloxy or arylthio, such as phenyl, 4-t-butylphenyl, 2,4,6-trimethylphenyl, phenoxy, 2- methylphenoxy, phenylthio or 2-butoxy-5-t-octylphenylthio; heterocyclyl, heterocyclyloxy or heterocyclylthio, each of which contain a 3 to 7 membered heterocyclic ring composed of carbon atoms and at least one hetero atom selected from oxygen, nitrogen and sulfur, such as 2-furyl, 2-thienyl, 2-benzimidazolyloxy or 2-benzothiazolyl; cyano; acyloxy, such as acetoxy or hexadecanoyloxy; carbamoyloxy, such as N-phenylcarbamoyloxy or N-ethylcarbamoyloxy; silyloxy, such as trimethylsilyloxy; sulfonyloxy, such as dodecylsulfonyloxy; acylamino, such as acetamido or benzamido; anilino, such as phenylanilino or 2-chloroanilino; ureido, such as phenylureido or methylureido; imido, such as N-succinimido or 3-benzylhydantoinyl; sulfamoylamino, such as N,N-dipropyl-sulfamoylamino or N- methyl-N-decylsulfamoylamino; carbamoylamino, such as N-butylcarbamoylamino or N,N-dimethylcarbamoylamino; alkoxycarbonylamino, such as methoxycarbonylamino or tetradecyloxycarbonylamino; aryloxycarbonylamino, such as phenoxycaronylamino, 2,4-di-t-butylphenoxycarbonylamino; sulfonamido, such as methanesulfonamido or hexadecanesulfonamido; carbamoyl group, such as N-ethylcarbamoyl or N,N-dibutylcarbamoyl; acyl, such as acetyl or (2,4-di-t-amylphenoxy)acetyl; sulfamoyl, such as N-ethylsulfamoyl or N,N-dipropylsulfamoyl; sulfonyl, such as methanesulfonyl or octanesulfonyl; sulfinyl, such as octanesulfinyl or dodecylsulfinyl; alkoxycarbonyl, such as methoxycarbonyl or butyloxycarbonyl; aryloxycarbonyl, such as phenyloxycarbonyl or 3-pentadecyloxycarbonyl; alkenyl; hydroxyl; amino; and carbonamido groups.

Possible substituents for the above substituted R groups include halogen, alkyl, aryl, aryloxy, heterocyclyl, cyano, alkoxy, acyloxy, carbamoyloxy, silyloxy, sulfonyloxy, acylamino, anilino, ureido, imido, sulfonylamino, carbamoylamino, alkylthio, arylthio, heterocyclylthio, alkoxycarbonylamino, aryloxycarbonylamino, sulfonamido, carbamoyl, acyl, sulfamoyl, sulfonyl, sulfinyl, alkoxycarbonyl, aryloxycarbonyl, alkenyl, carboxyl, sulfo, hydroxyl, amino and carbonamido groups.

Preferably, R represents hydrogen, an alkyl group, an aryl group, a carbonamido group, a sulfonamido group, a sulfone group, a thio group, a sulfoxide group, a ureido group or a heterocyclic group.

The coupling off group represented by X can be a hydrogen atom or any of the coupling-off groups known in the art. Coupling-off groups can determine the equivalency of the coupler, can modify the reactivity of the coupler, or can advantageously affect the layer in which the coupler is coated or other layers in the element by performing, after the release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclythio, sulfonamido, alkylthio, arylthio, heterocyclythio, sulfonamido, phosphonyloxy, and arylazo.

Preferably, X is hydrogen or halogen. Most preferably X is hydrogen or chlorine.

Specific couplers within the scope of the present invention have the following structures:

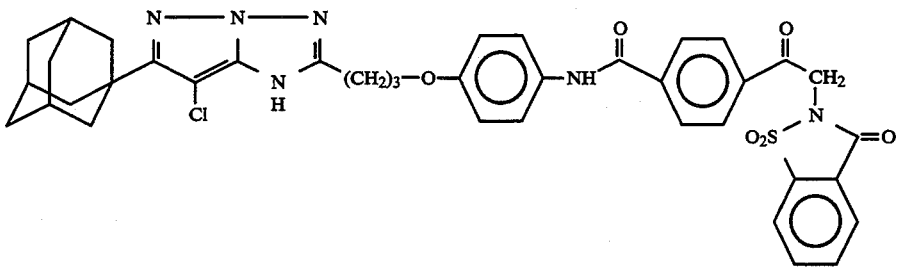
(M-1)
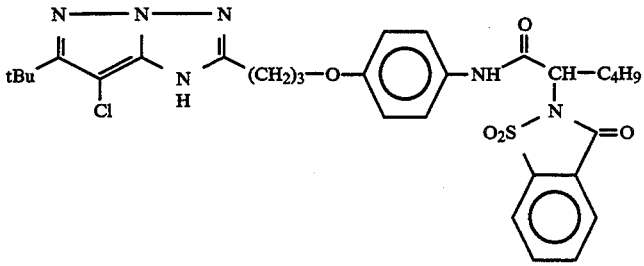
(M-2)
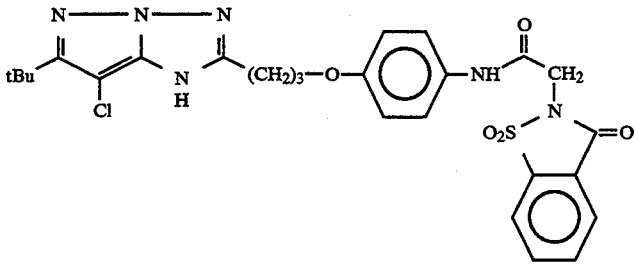
(M-3)
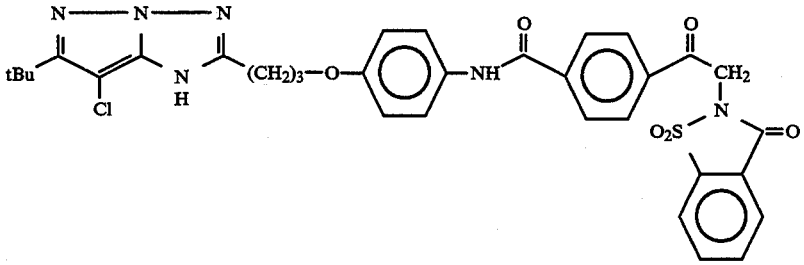
(M-4)
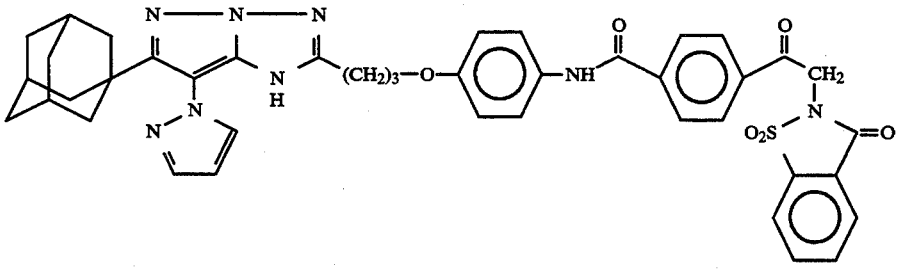
(M-5)
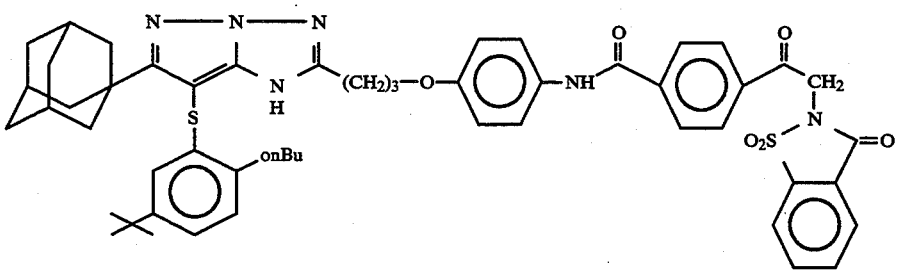
(M-6)

-continued
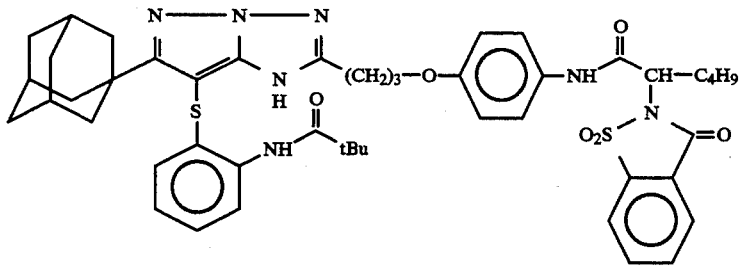
(M-7)
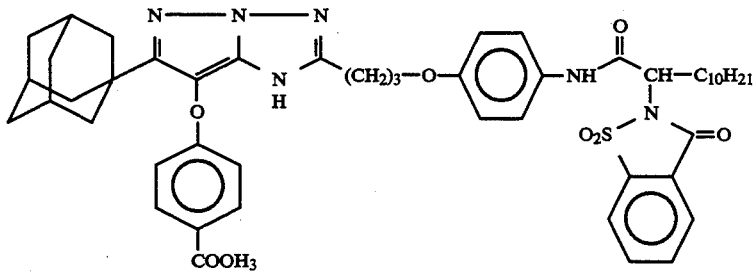
(M-8)
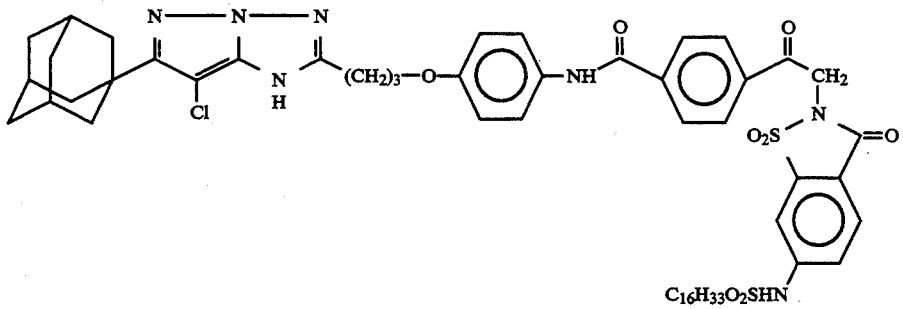
(M-9)
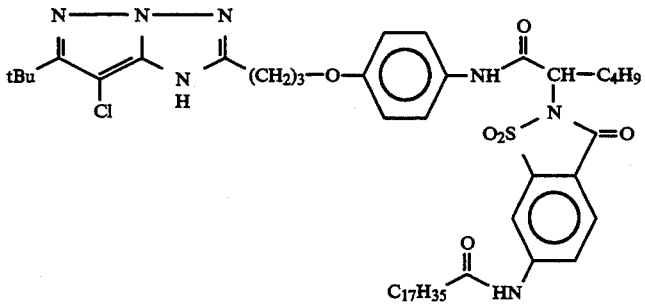
(M-10)
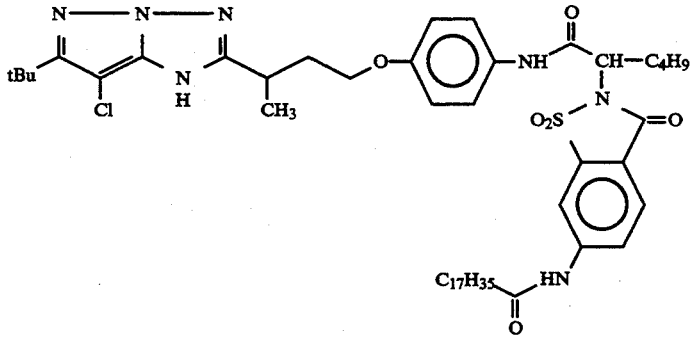
(M-11)

-continued

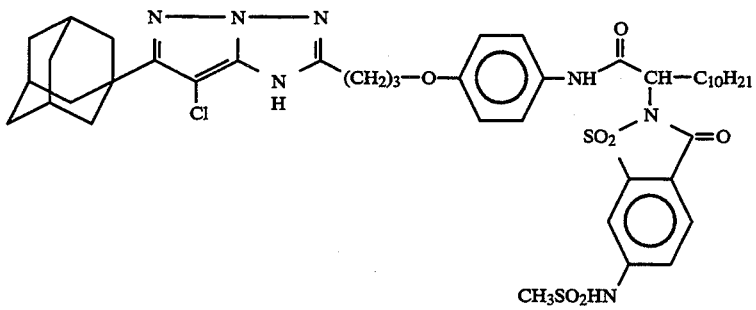

(M-12)

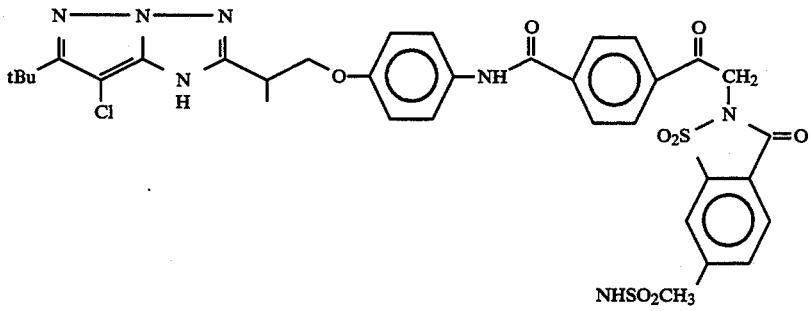

(M-13)

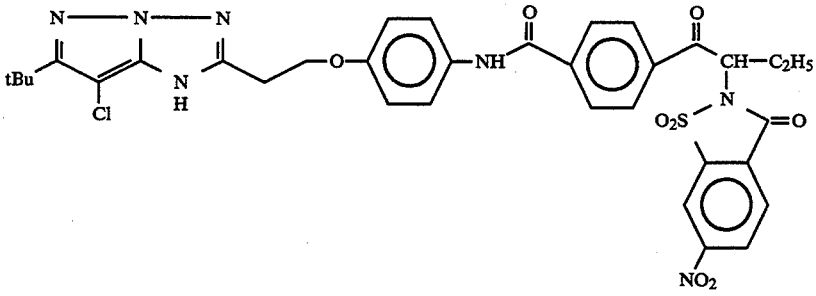

(M-14)

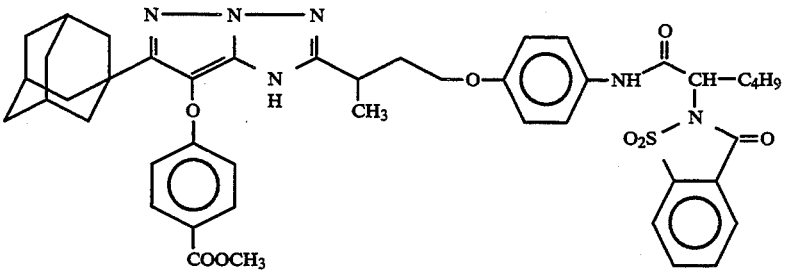

(M-15)

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the cyan couplers described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

The coupler compounds can be used and incorporated in photographic elements in the way that such compounds have been used in the past. Incorporation by use of a coupler solvent, as shown in the working examples, is a preferred technique.

The photographic elements of this invention can be exposed to actinic radiation, typically in the visible region of the spectrum, to form a latent image, as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The couplers of this invention are particularly effective when employed in a color photographic paper containing a silver chloride or silver bromochloride emulsion.

Couplers of the invention can be prepared by reactions and methods known in the organic synthesis art. A typical synthesis is illustrated by the following example.

Synthesis Example: Magenta Coupler: M-1

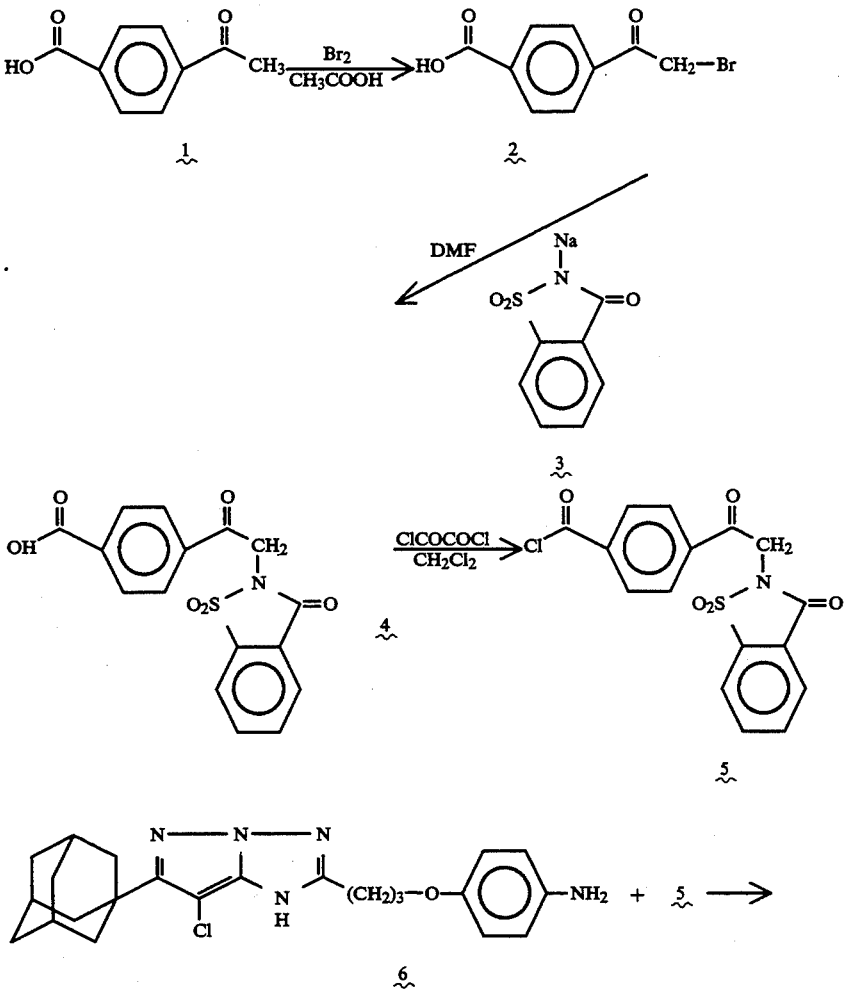

-continued

Synthesis Example: Magenta Coupler: M-1

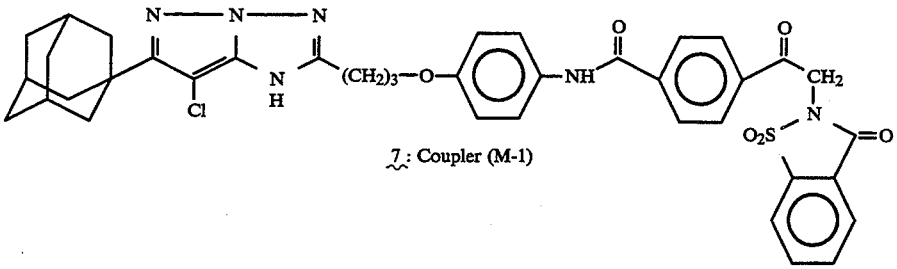

7: Coupler (M-1)

Preparation of 4-Bromoacetyl Benzoic Acid (2)

A rapidly stirred mixture of 8.40 g (0.015 mol) of acetyl benzoic acid in 130 mL of acetic acid was warmed to 35° C., followed by addition of 2.63 mL (8.15 g, 0.015 mol) bromine over a period of 25 minutes. During addition, the reaction temperature was maintained at 35° C. After addition, the reaction mixture was warmed to 70° C. and stirred for 20 minutes. Completion of the reaction was evidenced by thin layer chromatography analysis (elution with $CH_2Cl_2/CH_3COOC_2H_5/CH_3OH$:3/2/1). The solid was collected under suction, washed successively with 150 mL of acetic acid, two 200 mL portions of ether, and dried in vacuo to yield 8.2 g (65.3%) of a white solid. Analytical data confirmed the assigned structure.

Preparation of N-(4-Carboxy)phenacylsaccharin (4)

A solution of 8.0 g (0.032 mol) of 4-bromoacetyl benzoic acid and 47.5 g (0.23 mol) of sodium salt of 3-oxo-2,3-dihydrobenz[d]isothiazole-1,1-dioxide (saccharin) in 80 mL of dimethyl formamide (DMF) was stirred at room temperature for 1 day. The reaction mixture was poured into water and the resulting solid was collected, washed with water and dried in vacuo to yield 8.7 g (79%) of (4) as a white solid. Analytical data confirmed the assigned structure.

Preparation of N-(4-Chloromethanoyl)phenacylsaccharin (5)

A mixture of 8.7 g (0.025 mol) of N-(4-carboxy) phenacylsaccharin, 2 drops of DMF, and 100 mL of tetrahydrofuran (THF) was stirred at 22° C., followed by dropwise addition of 6.35 g (0.050 mol) of oxalyl chloride. The reaction mixture was stirred for 3 hours. The reaction mixture was concentrated in vacuo to afford the acid chloride (5) which was immediately employed in the following reaction.

Preparation of Magenta Coupler (7):M-1

A stirred mixture of 4.25 g (0.010 mol) of coupler amine (6) and 1.33 g (0.011 mol) of N,N-dimethylaniline in 50 mL of dried THF was cooled to 0° C., followed by portionwise addition of 3.66 g (0.010 mol) of N-(4-chloromethanoyl)phenacylsaccharin. The reaction mixture was stirred at 0° C. for 1 hour, allowed to warm to room temperature, and stirred for 2 hours. Completion of the reaction was evidenced by TLC (elution with $CH_2Cl_2/CH_3CO_2Et$:1/1). The mixture was poured into ice water. The resulting solid was collected, washed with water and dried in vacuo to yield 6.17 g (82%) of a solid. Analytical data confirmed the assigned structure (M-1).

Example

Preparation & Performance of Photographic Elements

The following example illustrates the practice of the present invention and the advantage in coupling efficiency compared with a coupler that does not contain a saccharin group as part of the ballast.

Coupler dispersions were prepared in the following manner. The quantities of each component are shown in Table I. In one vessel, the coupler, a stabilizer (2,2',3,3'-tetrahydro-3,3,3',3'-tetramethyl-5,5',6,6,'-tetrapropoxy-1,1'-spirobi[1H-indene]), coupler solvent (diethyl dodecanamide), and cyclohexanone were combined and warmed to dissolve. In a second vessel, gelatin, a surfactant (Alkanol XC TM of E. I. DuPont Co.) and water were combined and warmed to about 40° C. The two mixtures were combined and passed three times through a colloid mill. The cyclohexanone was removed by cooling the dispersion to about 5° C., cutting it into narrow strips, and washing for five hours in running water at 5° C.

TABLE I

| Disp. No. | Coup. No. | Grams Coup. | Grams Stab. | Grams Coup Solv. | Grams Cyclohexanone | Grams 12.5% Gel | Grams Alkanol XC TM (10%) | Grams Water |
|---|---|---|---|---|---|---|---|---|
| 1 | M-1 | 0.964 | 0.482 | 1.446 | 2.893 | 19/20 | 2.40 | 12.61 |
| 2 | C-1 | 0.632 | 0.316 | 0.948 | 1.897 | 19/20 | 2.40 | 14.61 |

Coupler M-1 is shown above. Coupler C-1 has the following structure:

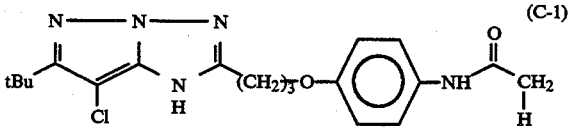

(C-1)

Photographic elements were prepared by coating the following layers in the order listed on a resin-coated paper support:

| | |
|---|---|
| 1st Layer | |
| Gelatin | 3.23 g/m$^2$ |
| 2nd Layer | |
| Gelatin | 1.61 g/m$^2$ |
| Coupler Dispersion (Table I) | 4.3 × $10^{-7}$ mole/m$^2$ |
| Green-sensitized AgCl emulsion | 0.17 mg Ag/m$^2$ |
| 3rd Layer | |
| Gelatin | 1.33 g/m2 |
| 2-(2H-benzotriazol-2-yl)-4,6-bis-(1,1-dimethylpropyl)phenol | 0.73 g/m2 |
| UV Absorber (Tinuvin 326 TM) | 0.13 g/m2 |
| 4th Layer | |
| Gelatin | 1.40 g/m$^2$ |

-continued

| | |
|---|---|
| Bis(vinylsulfonylmethyl) ether | 0.14 g/m$^2$ |

The photographic elements were given stepwise exposures to green light and processed as follows at 35° C.:

| | |
|---|---|
| Developer | 45 seconds |
| Bleach-Fix | 45 seconds |
| Wash (running water) | 90 seconds |

The developer and bleach-fix were of the following compositions:

| | |
|---|---|
| Developer | |
| Water | 700.00 mL |
| Triethanolamine | 12.41 g |
| Blankophor REU TM (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[4-amino-3-methylphenyl)ethylamino]-ethyl}-methanesulfonamide, sesquisulfate | 5.00 g |
| 1-Hydroxyethyl-1,1-diphosphonic acid(60%) | 0.81 g |
| Potassium carbonate, anhydrous | 21.16 g |
| Potassium bromide | 7.00 mg |
| Water to make | 1.00 L |
| pH @ 26.7° C. adjusted to 10.4 ± 0.05 | |
| Bleach-Fix | |
| Water | 700.00 mL |
| Soln. of ammonium thiosulfate (56.4%) and ammonium sulfate (4%) | 127.4 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 6.7 | |

Magenta dyes were formed upon processing. The maximum dye density to green light, (Dmax), for each element is shown in Table II.

TABLE II

| Element No. | Dispersion | Coupler | Dmin | Dmax |
|---|---|---|---|---|
| 1 | 1 | M-1 (invention) | 0.087 | 1.76 |
| 2 | 2 | C-2 (comparison) | 0.087 | 0.56 |

The higher maximum density (Dmax) obtained with the coupler having a ballast containing a saccharin moiety (M-1) compared with the coupler which does not contain a saccharin moiety (C-2) shows that couplers of the invention have greater coupling efficiency than do prior art couplers.

This invention has been described in detail with particular reference to preferred embodiments thereof. It will be understood that variations and modifications can be made within the spirit and scope of the invention.

What is claimed is:

1. A light-sensitive photographic element comprising a support bearing a silver halide emulsion associated with a cyclic azole coupler having the structure:

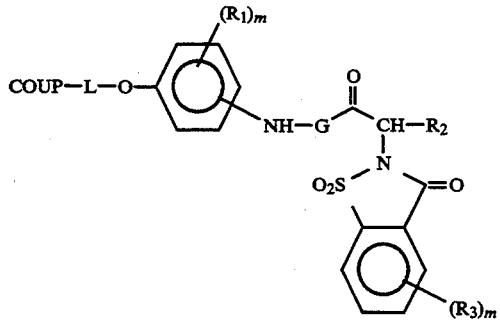

wherein:

COUP is a cyclic azole bridgehead nitrogen 5,5 fused ring system coupler moiety;

$R^1$, $R^2$ and $R^3$ independently represent a hydrogen or a substituent;

L is a linking group joining the aryleneoxy group to a position on the azole ring other than the coupling position;

G is a bi-valent linking group; and m is an integer of 0 to 2.

2. A photographic element of claim 1, wherein COUP is a pyrazolotriazole.

3. A photographic element of claim 2, wherein:

L is alkylene, arylene, alkylenesulfonyl or arylenesulfonyl;

each $R_1$ is independently alkyl or aryl which can be joined to the aryl ring via a hetero atom;

G is a chemical bond, oxyalkylene, oxyarylene, carbonylalkylene or carbonylarylene;

$R_2$ is hydrogen, halogen, or an aliphatic, aromatic or heterocyclic group; and each $R_3$ is independently hydroxy, halo, nitro, cyano, alkyl, alkoxy, aryl, aryloxy, alkylamino, alkylcarbonamido, alkylsulfonamido, heterocyclyl or trialkylsiloxy.

4. A photographic element of claim 1, wherein the coupler has the following sturucture:

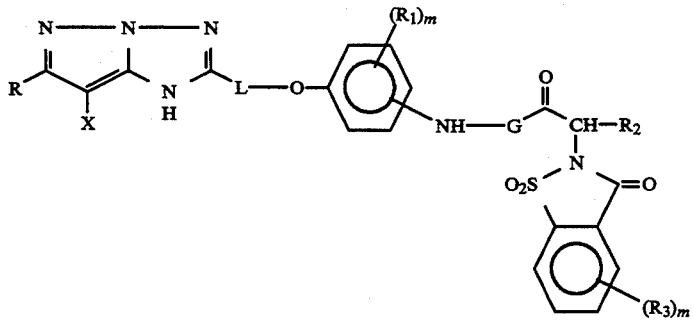

wherein:

$R_1$, $R_2$, $R_3$, L, G, and m are as defined;

R is hydrogen or a substituent;
X is hydrogen or a coupling off group.
5. A photographic element of claim 1, wherein the coupler is represented by one of the following formulae:
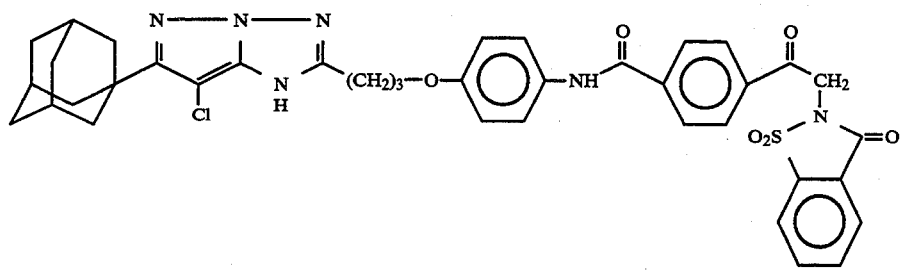
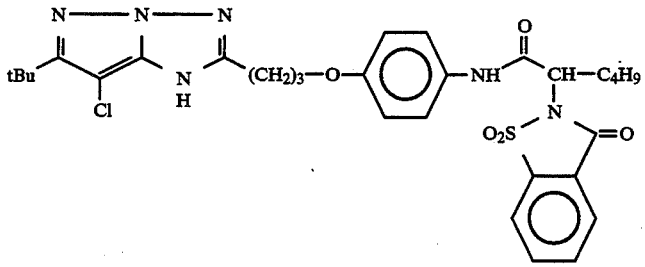
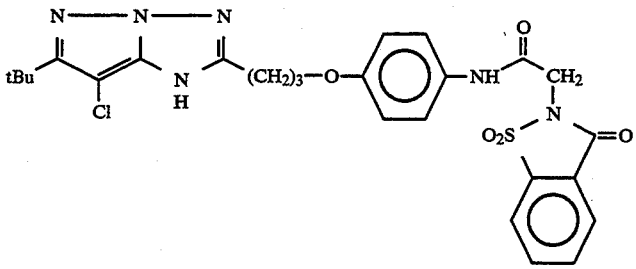
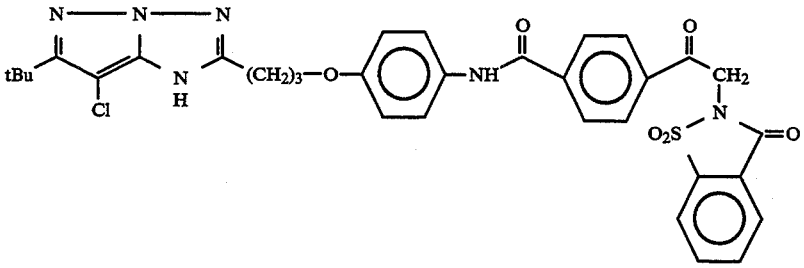
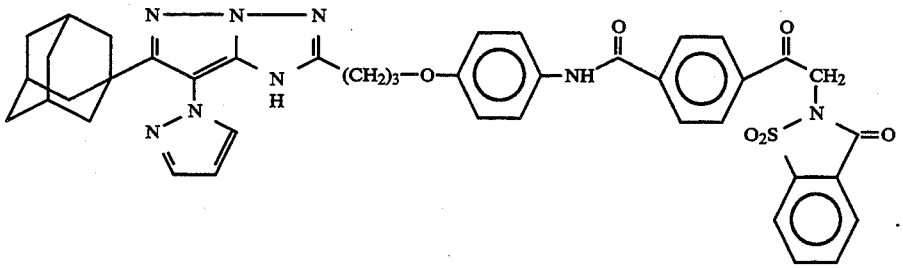
6. A photographic element of claim 1, wherein the silver halide emulsion comprises greater than 90 mole percent silver chloride.
* * * * *